US007270615B2

(12) United States Patent
Endo et al.

(10) Patent No.: US 7,270,615 B2
(45) Date of Patent: Sep. 18, 2007

(54) GOLF BALL

(75) Inventors: Seiichiro Endo, Kobe (JP); Masatoshi Yokota, Kobe (JP); Kazuhiko Isogawa, Kobe (JP)

(73) Assignee: SRI Sports Limited, Kobe (JP)

( * ) Notice: Subject to any disclaimer, the term of this patent is extended or adjusted under 35 U.S.C. 154(b) by 5 days.

(21) Appl. No.: 11/174,465

(22) Filed: Jul. 6, 2005

(65) Prior Publication Data

US 2006/0025240 A1 Feb. 2, 2006

(30) Foreign Application Priority Data

Jul. 29, 2004 (JP) ..... 2004-221812

(51) Int. Cl.
*A63B 37/12* (2006.01)

(52) U.S. Cl. ..... 473/377; 473/383

(58) Field of Classification Search ..... 473/373, 473/376, 377, 378, 383, 384
See application file for complete search history.

(56) References Cited

U.S. PATENT DOCUMENTS 6,106,415 A 8/2000 Masutani et al.
6,652,392 B2 * 11/2003 Higuchi et al. ..... 473/374
2002/0155902 A1 * 10/2002 Hayashi et al. ..... 473/371
2003/0120020 A1 6/2003 Yokota et al.

* cited by examiner

*Primary Examiner*—Raeann Trimiew
(74) *Attorney, Agent, or Firm*—Birch, Stewart, Kolasch & Birch, LLP

(57) ABSTRACT

Golf ball 2 has a core 4, a mid layer 6, a reinforcing layer 8 and a cover 10. Base polymer of the mid layer 6 includes an ionomer resin as a principal component. The mid layer 6 has a hardness Hm as measured with a Shore D type hardness scale of equal to or greater than 55. Base polymer of the reinforcing layer 8 is a thermosetting resin. Base polymer of the cover 10 includes a thermoplastic polyurethane elastomer as a principal component. The cover 10 has a nominal thickness Tc of equal to or less than 0.6 mm. The cover 10 has a hardness Hc as measured with a Shore D type hardness scale of equal to or less than 54. Ratio (Tr/Tc) of the thickness Tr of the reinforcing layer to the nominal thickness Tc of the cover is 0.005 or greater and 3.0 or less. This golf ball 2 includes dimples 12 having a depth Dp. Thickness Td of the cover 10 immediately below the deepest site of one or more of the dimples 12 is greater than (Tc−Dp).

7 Claims, 6 Drawing Sheets

GOLF BALL

This application claims priority on Patent Application No. 2004-221812 filed in JAPAN on Jul. 29, 2004, the entire contents of which are hereby incorporated by reference.

BACKGROUND OF THE INVENTION

1. Field of the Invention

The present invention relates to golf balls. More particularly, the present invention relates to multi piece golf balls having a core, a mid layer and a cover.

2. Description of the Related Art

Top concern to golf players for golf balls is their flight performances. The golf players particularly place great importance on flight distance attained upon shots with a driver. The golf players also place great importance on flight distance attained upon shots with a long iron and a middle iron.

Golf players also place great importance on spin performances of golf balls. Great back spin rate results in small run. For golf players, golf balls which are liable to be spun backwards are apt to be rendered to stop at a targeted position. Great side spin rate results in easily curved trajectory of the golf ball. For golf players, golf balls which are liable to be spun sidewise are apt to allow their trajectory to curve intentionally. Golf balls that are excellent in spin performances are excellent in control performances. High-level golf players particularly place great importance on control performances upon shots with a short iron.

For golf players, durability of golf balls is also important. Golf balls that are not damaged by repeated hitting have been desired. Further, golf balls that are resistant to generation of cuts and wrinkles on the cover upon full shots with a short iron have been desired.

In light of the flight performances, control performances and durability, golf balls having a variety of structures have been proposed. For example, U.S. Pat. No. 6,106,415 discloses a golf ball having a core, a mid layer comprising an ionomer resin and a cover comprising polyurethane.

Golf balls have numerous dimples on the surface thereof. The dimples cause turbulent flow separation through disrupting the air flow around the golf ball during the flight. By causing the turbulent flow separation, a separating point of air from the golf ball shifts backwards leading to the reduction of a drag. The turbulent flow separation promotes the differentia between upper separating point and lower separating point of the golf ball, which results from the backspin, thereby enhancing the lift force that acts upon the golf ball.

Covers having high elasticity are advantageous in terms of the flight performance. However, highly elastic covers liable to deteriorate the control performance. Soft covers are advantageous in terms of the control performance. However, soft covers are disadvantageous in terms of the flight performance and durability. Demands from the golf players for golf balls have increasingly escalated in recent years. Highly balanced flight performances, control performances and durability have been desired. An object of the present invention is to provide golf balls that are excellent in flight performances, control performances and durability.

SUMMARY OF THE INVENTION

A golf ball according to the present invention has a spherical core, a mid layer positioned outside of this core, a reinforcing layer positioned outside of this mid layer and a cover positioned outside of this reinforcing layer. Principal component of the base polymer of this mid layer is an ionomer resin. This mid layer has a hardness Hm as measured with a Shore D type hardness scale of equal to or greater than 55. Principal component of the base polymer of this cover is a thermoplastic polyurethane elastomer. This cover has a nominal thickness Tc of equal to or less than 0.6 mm. This cover has a hardness Hc as measured with a Shore D type hardness scale of equal to or less than 54. Ratio (Tr/Tc) of the thickness Tr of the reinforcing layer to the nominal thickness Tc of the cover is 0.005 or greater and 3.0 or less. This golf ball comprises dimples having a depth Dp on the surface thereof. Thickness Td of the cover immediately below the deepest site of one or more of the dimples is greater than (Tc−Dp).

Preferably, proportion P1 of number of the dimples on the cover having a thickness Td immediately below the deepest site of the dimple of greater than (Tc−Dp), occupying in total number of the dimples is equal to or greater than 30%. Preferably, proportion P2 of number of the dimples on the cover having a thickness Td immediately below the deepest site of the dimple of equal to or greater than (Tc−Dp+0.03), occupying in total number of the dimples is equal to or greater than 30%.

Preferably, base polymer of the reinforcing layer is a thermosetting resin. Preferably, this reinforcing layer has a tensile strength of 150 kgf/cm$^2$ or greater and 500 kgf/cm$^2$ or less. Preferably, this reinforcing layer has a pencil hardness of 4B or greater and 3H or less.

Because low head speed is achieved upon shots with a short iron, amount of deformation of the golf ball is small. Upon shots with a short iron, spin rate primarily depends on the material of the surface of the cover. Because the golf ball according to the present invention has a cover comprising a thermoplastic polyurethane elastomer as a principal component and having a hardness Hc of equal to or less than 54, slipping that occurs between the club face and the golf ball upon impact is suppressed. According to this golf ball, a great spin rate is achieved upon a shot with a short iron. This golf ball is excellent in a control performance upon a shot with a short iron.

Upon shots with a driver, the mid layer and the core are also deformed greatly in conjunction with the cover. Covers having a low hardness Hc may be disadvantageous in terms of resilience performances, however, less adverse effects are exerted on the resilience performance because this cover is very thin. According to this golf ball, the mid layer is responsible for the resilience performance. This golf ball is excellent in a flight performance upon a shot with a driver.

Spin rate predominantly depends on deformative behavior of the cover upon shots with a long iron and a middle iron. Because this cover is very thin, the amount of deformation is small irrespective of the hardness Hc being small. Spin rate upon impact of this golf ball with a long iron or a middle iron is low. Low spin rate leads to a great flight distance. This golf ball is excellent in a flight performance upon a shot with a long iron and a middle iron.

In general, thickness Td of the cover immediately below the dimple is less than nominal thickness Tc. In a golf ball having a small nominal thickness Tc, the cover immediately below the dimple is fragile, and thus, cuts and wrinkles upon shots with a short iron are liable to be generated. In the golf ball according to the present invention, synergistic effect of the thickness Td being greater than (Tc−Dp) and the presence of the reinforcing layer suppress generation of cuts and wrinkles. The reinforcing layer also suppresses breaking of the cover due to repeated hitting. This golf ball is excellent in durability irrespective of the cover being thin. The cover having a thickness Td of greater than (Tc−Dp) is also excellent in formability.

DESCRIPTION OF THE PREFERRED EMBODIMENTS

The present invention is hereinafter described in detail with appropriate references to the accompanying drawing according to the preferred embodiments.

Figure 1:
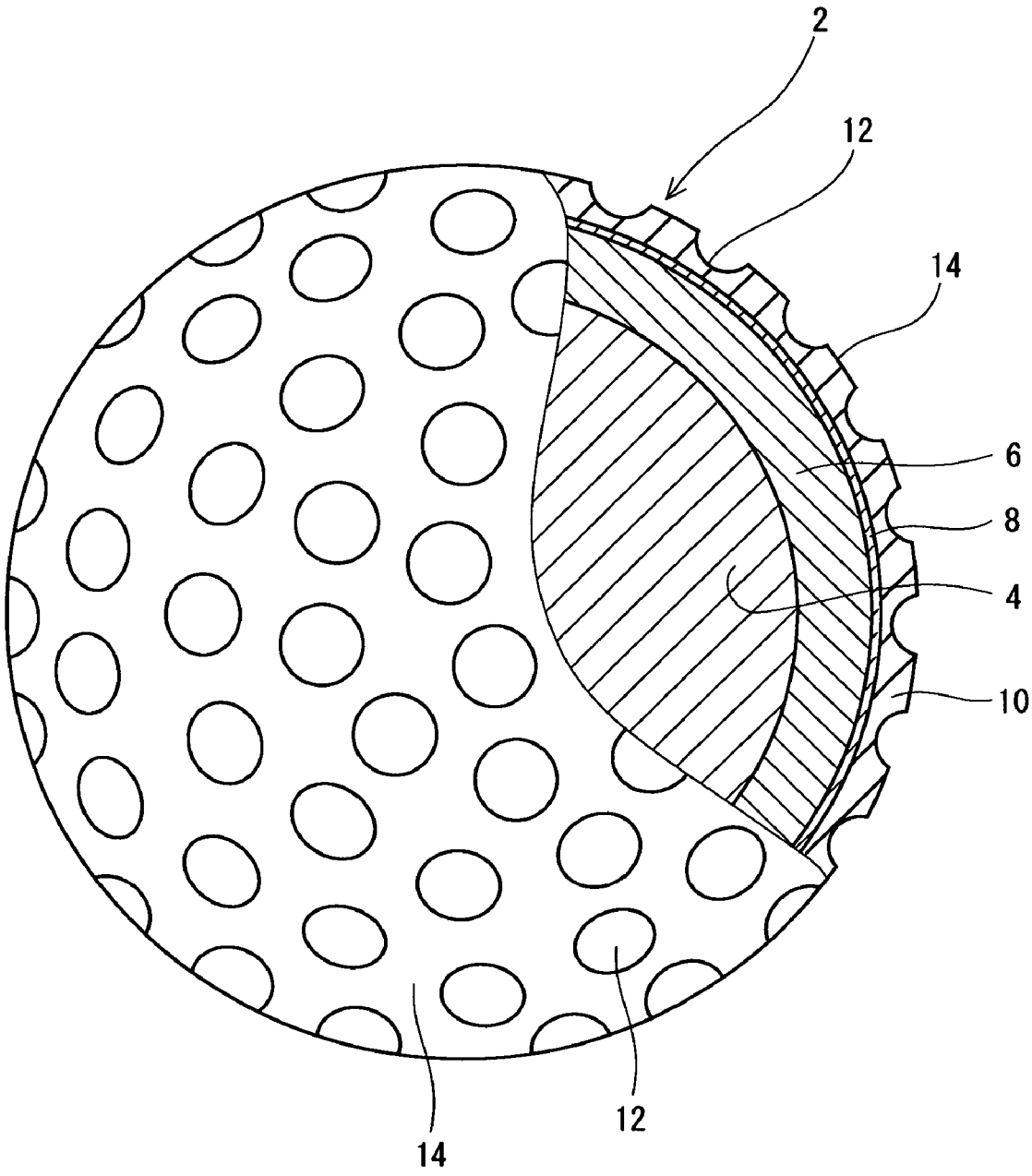
FIG. 1 is a partially cut off cross-sectional view illustrating a golf ball according to one embodiment of the present invention.

A golf ball 2 depicted in FIG. 1 has a spherical core 4, a mid layer 6 covering this core 4, a reinforcing layer 8 covering this mid layer 6, and a cover 10 covering this reinforcing layer 8. Numerous dimples 12 are formed on the surface of the cover 10. Of the surface of the cover 10, a part except for the dimples 12 is a land 14. Although this golf ball 2 has a paint layer and a mark layer to the external side of the cover 10, these layers are not shown in the Figure.

This golf ball 2 has a diameter of from 40 mm to 45 mm. From the standpoint of conformity to a rule defined by United States Golf Association (USGA), the diameter is preferably equal to or greater than 42.67 mm. In light of suppression of the air resistance, the diameter is preferably equal to or less than 44 mm, and more preferably equal to or less than 42.80 mm. Weight of this golf ball 2 is 40 g or greater and 50 g or less. In light of attainment of great inertia, the weight is preferably equal to or greater than 44 g, and more preferably equal to or greater than 45.00 g. From the standpoint of conformity to a rule defined by USGA, the weight is preferably equal to or less than 45.93 g.

The core 4 is usually obtained through crosslinking of a rubber composition. Examples of preferred base rubber include polybutadienes, polyisoprenes, styrene-butadiene copolymers, ethylene-propylene-diene copolymers and natural rubbers. In light of the resilience performance, polybutadienes are preferred. When other rubber is used in combination with polybutadiene, it is preferred that polybutadiene is included as a principal component. Specifically, the proportion of polybutadiene occupying in total base rubber is preferably equal to or greater than 50% by weight, and particularly preferably equal to or greater than 80% by weight. Polybutadienes, which have a percentage of cis-1,4 bond of equal to or greater than 40%, and particularly equal to or greater than 80%, are preferred, in particular.

For crosslinking of the core 4, a co-crosslinking agent is usually used. Preferable co-crosslinking agent in light of the resilience performance is a monovalent or bivalent metal salt of an α,β-unsaturated carboxylic acid having 2 to 8 carbon atoms. Specific examples of preferable co-crosslinking agent include zinc acrylate, magnesium acrylate, zinc methacrylate and magnesium methacrylate. Zinc acrylate and zinc methacrylate are particularly preferred on the ground that a high resilience performance can be achieved.

As a co-crosslinking agent, an α,β-unsaturated carboxylic acid having 2 to 8 carbon atoms, and an oxidized metal may be blended. Both components react in the rubber composition to give a salt. This salt is responsible for the crosslinking reaction. Examples of preferable α,β-unsaturated carboxylic acid include acrylic acid and methacrylic acid. Examples of preferable oxidized metal include zinc oxide and magnesium oxide.

In light of the resilience performance of the golf ball 2, the amount of the co-crosslinking agent to be blended is preferably equal to or greater than 10 parts by weight, and more preferably equal to or greater than 15 parts by weight per 100 parts by weight of the base rubber. In light of soft feel at impact, the amount of the co-crosslinking agent to be blended is preferably equal to or less than 50 parts by weight, and more preferably equal to or less than 45 parts by weight per 100 parts by weight of the base rubber.

It is preferred that an organic peroxide is blended together with the co-crosslinking agent into the rubber composition for use in the core 4. The organic peroxide serves as a crosslinking initiator. By blending the organic peroxide, the resilience performance of the golf ball 2 may be improved. Examples of suitable organic peroxide include dicumyl peroxide, 1,1-bis(t-butylperoxy)-3,3,5-trimethylcyclohexane, 2,5-dimethyl-2,5-di(t-butylperoxy)hexane and di-t-butyl peroxide. Particularly versatile organic peroxide is dicumyl peroxide.

In light of the resilience performance of the golf ball 2, the amount of the organic peroxide to be blended is preferably equal to or greater than 0.1 part by weight, more preferably equal to or greater than 0.3 part by weight, and particularly preferably equal to or greater than 0.5 part by weight per 100 parts by weight of the base rubber. In light of soft feel at impact, the amount of the organic peroxide to be blended is preferably equal to or less than 3.0 parts by weight, and more preferably equal to or less than 2.5 parts by weight per 100 parts by weight of the base rubber.

A filler may be blended into the core 4 for the purpose of adjusting specific gravity and the like. Illustrative examples of suitable filler include zinc oxide, barium sulfate, calcium carbonate and magnesium carbonate. Also, powder consisting of a highly dense metal may be blended as a filler. Specific examples of the highly dense metal include tungsten and molybdenum. The amount of the filler to be blended is determined ad libitum so that intended specific gravity of the core 4 can be accomplished. Particularly preferable filler is zinc oxide. Zinc oxide serves not only in adjusting specific gravity but also as a crosslinking activator. Various kinds of additives such as sulfur, a sulfur compound, an anti-aging agent, a coloring agent, a plasticizer, a dispersant and the like may be blended in an appropriate amount to the core 4 as needed. The core 4 may be also blended with crosslinked rubber powder or synthetic resin powder.

Amount of compressive deformation of the core 4 is preferably equal to or less than 5.0 mm, more preferably equal to or less than 4.5 mm, and particularly preferably equal to or less than 4.0 mm. When the golf ball 2 is hit with a driver, the core 4 is also deformed greatly in conjunction with the cover 10 and the mid layer 6. The core 4 having a small amount of compressive deformation is responsible for a flight performance upon a shot with a driver. The core 4 having too small amount of compressive deformation deteriorates the feel at impact of the golf ball 2. In light of the feel at impact, the amount of compressive deformation is preferably equal to or greater than 1.5 mm, and particularly preferably equal to or greater than 2.0 mm.

For the measurement of the amount of compressive deformation, a core 4 is first placed on a hard plate made of metal. Next, a cylinder made of metal gradually descends toward the core 4. Accordingly, the core 4, which is sandwiched between the bottom face of the cylinder and the hard plate, is deformed. A migration distance of the cylinder, starting from the state in which initial load of 98 N is applied to the core 4 up to the state in which final load of 1274 N is applied thereto is the amount of compressive deformation.

The core 4 preferably has a diameter of 25.0 mm or greater and 41.5 mm or less. The core 4 preferably has a weight of 25 g or greater and 42 g or less. Crosslinking temperature of the core 4 is usually 140° C. or greater and 180° C. or less. The crosslinking time period of the core 4 is usually 10 minutes or longer and 60 minutes or less. The core 4 may be formed with two or more layers. Other layer comprising a resin composition or a rubber composition may be provided between the core and the mid layer.

The mid layer 6 comprises a thermoplastic resin composition. The base polymer of the resin composition is an ionomer resin. Ionomer resins are highly elastic. As described later, the cover 10 of this golf ball 2 is very thin. When this golf ball 2 is hit with a driver, the mid layer 6 is greatly deformed. The mid layer 6 in which an ionomer resin is used is responsible for a flight performance upon a shot with a driver.

Preferably, an ionomer resin is used that is a copolymer of α-olefin and an α,β-unsaturated carboxylic acid having 3 to 8 carbon atoms in which a part of the carboxylic acid is neutralized with a metal ion. Examples of preferable α-olefin include ethylene and propylene. Examples of preferable α,β-unsaturated carboxylic acid include acrylic acid and methacrylic acid. Illustrative examples of the metal ion for use in the neutralization include sodium ion, potassium ion, lithium ion, zinc ion, calcium ion, magnesium ion, aluminum ion and neodymium ion. The neutralization may also be carried out with two or more kinds of the metal ions. In light of the resilience performance and durability of the golf ball 2, particularly suitable metal ions are sodium ion, zinc ion, lithium ion and magnesium ion.

Specific examples of the ionomer resin include trade names "Himilan 1555", "Himilan 1557", "Himilan 1605", "Himilan 1706", "Himilan 1707", "Himilan AM7311", "Himilan AM7315", "Himilan AM7317", "Himilan AM7318" and "Himilan MK7320", available from Du Pont-MITSUI POLYCHEMICALS Co., Ltd.; trade names "Surlyn® 7930", "Surlyn® 7940", "Surlyn® 8140", "Surlyn® 8940", "Surlyn® 8945", "Surlyn® 9120", "Surlyn® 9910" and "Surlyn® 9945", available from Dupont Co.; and trade names "IOTEK 7010", "IOTEK 7030", "IOTEK 8000" and "IOTEK 8030", available from EXXON Corporation.

Other resin may be used in combination with the ionomer resin as the base polymer. Illustrative examples of the other resin include thermoplastic polyester elastomers, thermoplastic polyamide elastomers, thermoplastic polyurethane elastomers, thermoplastic polyolefin elastomers and thermoplastic polystyrene elastomers. When the ionomer resin and the other resin are used in combination, the ionomer resin is included as a principal component of the base polymer in light of the flight performance. Proportion of the ionomer resin occupying in the total base polymer is preferably equal to or greater than 50% by weight, more preferably equal to or greater than 70% by weight, and particularly preferably equal to or greater than 85% by weight.

Into the resin composition of the mid layer 6 may be blended a filler for the purpose of adjusting specific gravity and the like. Illustrative examples of suitable filler include zinc oxide, barium sulfate, calcium carbonate and magnesium carbonate. Powder of a highly dense metal may be also blended as a filler. Specific examples of the highly dense metal include tungsten and molybdenum. The amount of the filler to be blended is determined ad libitum so that the intended specific gravity of the mid layer 6 can be accomplished. Into the mid layer 6 may be also blended a coloring agent, crosslinked rubber powder or synthetic resin powder.

In light of the flight performance upon a shot with a driver, the mid layer 6 has a hardness Hm of preferably equal to or greater than 55, more preferably equal to or greater than 58, and particularly preferably equal to or greater than 60. When the hardness Hm is extremely great, to achieve a favorable feeling upon impact of the golf ball 2 may become difficult. In this respect, the hardness Hm is preferably equal to or less than 72, more preferably equal to or less than 70, and particularly preferably equal to or less than 68.

In the present invention, the hardness Hm of the mid layer 6 and the hardness Hc of the cover 10 are measured in accordance with a standard of "ASTM-D 2240-68". For the measurement, an automated rubber hardness scale which is equipped with a Shore D type spring hardness scale (trade name "LA1", available from Koubunshi Keiki Co., Ltd.) is used. For the measurement, a sheet which is formed by hot press is used having a thickness of about 2 mm and consisting of the same material as the mid layer 6 (or the cover 10). Prior to the measurement, the sheet is stored at a temperature of 23° C. for two weeks. When the measurement is carried out, three sheets are overlaid.

In light of the flight performance upon a shot with a driver, the mid layer 6 has a thickness Tm of preferably equal to or greater than 0.3 mm, more preferably equal to or greater than 0.5 mm, and particularly preferably equal to or greater than 0.7 mm. When the thickness Tm is too great, to achieve a favorable feeling upon impact of the golf ball 2 may become difficult. In this respect, the thickness Tm is preferably equal to or less than 2.5 mm, and more preferably equal to or less than 2.0 mm. The thickness Tm is measured at a place except for immediately below the dimple 12.

In light of adhesion between the mid layer 6 and the reinforcing layer 8 or the cover 10, the surface of the mid layer 6 is preferably subjected to a surface treatment to increase the roughness thereof. Specific examples of the treatment include brushing, grinding and the like.

The reinforcing layer 8 lies between the mid layer 6 and the cover 10. As described later, the cover 10 of this golf ball 2 is very thin. When such a thin cover 10 is hit with a short iron, a wrinkle is liable to be generated. The wrinkle is generated by displacement of the cover 10 with respect to the mid layer 6. The reinforcing layer 8 prevents the displacement of the cover 10 with respect to the mid layer 6, and prevents cutting of the cover 10 immediately below the dimple 12. Presence of the reinforcing layer 8 results in suppression of generation of the wrinkle. Furthermore, the reinforcing layer 8 firmly adheres to the mid layer 6, and also adheres firmly to the cover 10. The reinforcing layer 8 suppresses breakage of the cover 10. The golf ball 2 having the reinforcing layer 8 is excellent in durability.

For the base polymer of the reinforcing layer 8, a two-component cured thermosetting resin may be suitably used. Specific examples of the two-component cured thermosetting resin include epoxy resins, urethane resins, acrylic resins, polyester based resins and cellulose based resins. In light of the mechanical strength (e.g., strength at break) and durability of the reinforcing layer 8, two-component cured epoxy resins and two-component cured urethane resins are preferred.

The two-component cured epoxy resin is obtained by curing an epoxy resin with a polyamide based curing agent. Illustrative examples of the epoxy resin for use in the two-component cured epoxy resin include bisphenol A type epoxy resin, bisphenol F type epoxy resin and bisphenol AD type epoxy resin. The bisphenol A type epoxy resin is obtained by a reaction of bisphenol A with an epoxy group-containing compound such as epichlorohydrin. The bisphenol F type epoxy resin is obtained by a reaction of bisphenol F with an epoxy group-containing compound. The bisphenol AD type epoxy resin is obtained by a reaction of bisphenol AD with an epoxy group-containing compound. In light of the balance among softness, chemical resistance, heat resistance and toughness, the bisphenol A type epoxy resin is preferred.

The polyamide based curing agent has multiple amino groups and one or more amide groups. This amino group can react with an epoxy group. Specific examples of the polyamide based curing agent include polyamide amine curing agents and denatured products of the same. The polyamide amine curing agent is obtained by a condensation reaction of a polymerized fatty acid with a polyamine. Typical polymerized fatty acid may be obtained by heating naturally occurring fatty acids containing large amounts of unsaturated fatty acids such as linoleic acid, linolenic acid and the like in the presence of a catalyst to perfect the synthesis. Specific examples of the unsaturated fatty acid include tall oil, soybean oil, linseed oil and fish oil. Polymerized fatty acids having a dimer content of equal to or greater than 90% by weight and a trimer content of equal to or less than 10% by weight, and being hydrogenated are preferred. Illustrative examples of preferred polyamine include polyethylene diamine, polyoxyalkylene diamine and derivatives thereof.

Upon mixing of the epoxy resin and the polyamide based curing agent, ratio of epoxy equivalent of the epoxy resin and amine active hydrogen equivalent of the polyamide based curing agent is preferably 1.0/1.4 or greater and 1.0/1.0 or less.

The two-component cured urethane resin is obtained by a reaction of a base material and a curing agent. A two-component cured urethane resin obtained by a reaction of a base material containing a polyol component with a curing agent containing polyisocyanate or a derivative thereof, or a two-component cured urethane resin obtained by a reaction of a base material containing isocyanate group-ended urethane prepolymer with a curing agent having an active hydrogen may be used. In particular, the two-component cured urethane resins obtained by a reaction of a base material containing a polyol component with a curing agent containing polyisocyanate or a derivative thereof are preferred.

It is preferred that an urethane polyol is used as the polyol component of the base material. The urethane polyol has urethane bonds and at least two or more hydroxyl groups. Preferably, the urethane polyol has a hydroxyl group at its end. The urethane polyol may be obtained by allowing a polyol and polyisocyanate to react at a ratio such that an excessive molar ratio of the hydroxyl group of the polyol component to the isocyanate group of polyisocyanate is attained.

The polyol for use in production of the urethane polyol has multiple hydroxyl groups. Polyol having a weight average molecular weight of 50 or greater and 2000 or less, and particularly 100 or greater and 1000 or less is preferred. Examples of the polyol having a low molecular weight include diol and triol. Specific examples of the diol include ethylene glycol, diethylene glycol, triethylene glycol, 1,3-butanediol, 1,4-butanediol, neopentyl glycol and 1,6-hexanediol. Specific examples of the triol include trimethylolpropane and hexanetriol. Examples of the polyol having a high molecular weight include polyether polyols such as polyoxyethylene glycol (PEG), polyoxypropylene glycol (PPG) and polyoxytetramethylene glycol (PTMG); condensed polyester polyols such as polyethylene adipate (PEA), polybutylene adipate (PBA) and polyhexamethylene adipate (PHMA); lactone based polyester polyols such as poly-ϵ-caprolactone (PCL); polycarbonate polyols such as polyhexamethylene carbonate; and acrylic polyols. Two or more kinds of polyols may be used in combination.

Polyisocyanate for use in production of the urethane polyol has multiple isocyanate groups. Specific examples of the polyisocyanate include aromatic polyisocyanates such as 2,4-toluene diisocyanate, 2,6-toluene diisocyanate, mixtures of 2,4-toluene diisocyanate and 2,6-toluene diisocyanate (TDI), 4,4'-diphenylmethane disocyanate (MDI), 1,5-naphthylene diisocyanate (NDI), 3,3'-bitolylene-4,4'-diisocyanate (TODI), xylylene diisocyanate (XDI), tetramethylxylylene diisocyanate (TMXDI) and paraphenylene diisocyanate (PPDI); alicyclic polyisocyanates such as 4,4'-dicyclohexylmethane diisocyanate ($H_{12}$MDI), hydrogenated xylylene diisocyanate ($H_6$XDI), hexamethylene diisocyanate (HDI) and isophorone diisocyanate (IPDI); and aliphatic polyisocyanates. Two or more polyisocyanates may be used in combination. In light of the weather resistance, TMXDI, XDI, HDI, $H_6$XDI, IPDI and $H_{12}$MDI are preferred.

In the reaction of a polyol with polyisocyanate for producing the urethane polyol, any known catalyst may be used. Typical catalyst may be dibutyltin dilaurate.

In light of strength of the reinforcing layer 8, ratio of urethane bonds included in the urethane polyol is preferably equal to or greater than 0.1 mmol/g. In light of the following capability of the reinforcing layer 8 to the cover 10, the ratio of urethane bonds included in the urethane polyol is preferably equal to or less than 5 mmol/g. The ratio of urethane bonds may be adjusted by adjusting the molecular weight of the polyol to be a raw material, and by adjusting compounding ratio of the polyol and the polyisocyanate.

In light of a short time period required for the reaction of the base material with the curing agent, the urethane polyol has a weight average molecular weight of preferably equal to or greater than 4000, and more preferably equal to or greater than 4500. In light of adhesiveness of the reinforcing layer 8, the urethane polyol has a weight average molecular weight of preferably equal to or less than 10000, and more preferably equal to or less than 9000.

In light of adhesiveness of the reinforcing layer 8, the urethane polyol has a hydroxyl value (mg KOH/g) of preferably equal to or greater than 15, and more preferably equal to or greater than 73. In light of a short time period required for the reaction of the base material with the curing agent, the urethane polyol has a hydroxyl value of preferably equal to or less than 130, and more preferably equal to or less than 120.

The base material may contain, in addition to the urethane polyol, a polyol not having any urethane bond. The aforementioned polyol that is a raw material of the urethane polyol may be used in the base material. Polyols that are miscible with the urethane polyol are preferred. In light of a short time period required for the reaction of the base material with the curing agent, proportion of the urethane polyol in the base material is preferably equal to or greater than 50% by weight and more preferably equal to or greater than 80% by weight based on the solid content. Ideally, this proportion is 100% by weight.

The curing agent contains polyisocyanate or a derivative thereof. The aforementioned polyisocyanate that is a raw material of the urethane polyol may be used as the curing agent.

The reinforcing layer 8 may include additives such as a coloring agent (typically, titanium dioxide), a phosphate based stabilizer, an antioxidant, a light stabilizer, a fluorescent brightening agent, an ultraviolet absorbent, a blocking preventive agent and the like. The additive may be added to the base material of the two-component cured thermosetting resin, or may be added to the curing agent.

The reinforcing layer 8 is obtained by coating a liquid, which is prepared by dissolving or dispersing the base material and the curing agent in a solvent, on the surface of the mid layer 6. In light of the workability, coating with a spray gun is preferred. The solvent is volatilized after the coating to permit a reaction of the base material with the curing agent thereby forming the reinforcing layer 8. Illustrative examples of preferred solvent include toluene, isopropyl alcohol, xylene, methyl ethyl ketone, methyl isobutyl ketone, ethylene glycol monomethyl ether, ethylbenzene, propylene glycol monomethyl ether, isobutyl alcohol and ethyl acetate.

In light of the durability of the golf ball 2, ratio (Tr/Tc) of the thickness Tr of the reinforcing layer 8 to the nominal thickness Tc of the cover 10 is preferably equal to or greater than 0.005, more preferably equal to or greater than 0.010, and particularly preferably equal to or greater than 0.020. When the ratio (Tr/Tc) is too great, resilience coefficient upon shots with a driver, a long iron and a middle iron may become insufficient. In this respect, the ratio (Tr/Tc) is preferably equal to or less than 3.0, and more preferably equal to or less than 2.0.

In light of the durability of the golf ball 2, the reinforcing layer 8 has a thickness of preferably equal to or greater than 0.003 mm, and more preferably equal to or greater than 0.005 mm. In light of easy formation of the reinforcing layer 8, it is preferred that the thickness is equal to or less than 0.30 mm, still more, equal to or less than 0.10 mm, yet more, equal to or less than 0.05 mm, and further, equal to or less than 0.02 mm. The thickness is measured by observation of the cross section of the golf ball 2 with a micro scope. When the surface of the mid layer 6 has roughness resulting from the surface roughening treatment, the thickness is measured immediately above the protruded portion. The measurement is carried out at a place except for immediately below the dimple 12.

In light of the durability of the golf ball 2, the reinforcing layer 8 has a tensile strength of preferably equal to or greater than 150 kgf/cm$^2$, and more preferably equal to or greater than 200 kgf/cm$^2$. In light of the feel at impact, the tensile strength is preferably equal to or less than 500 kgf/cm$^2$. The tensile strength is measured in accordance with a standard of "JIS K5400". A sample subjected to the measurement is obtained by applying a coating composition on a test plate with a spray gun. The coating composition is kept in an atmosphere of 40° C. for 24 hours. The strain rate for the measurement is 50 mm/min.

The reinforcing layer 8 has a pencil hardness of preferably equal to or greater than 4B. This reinforcing layer 8 prevents the displacement of the cover 10 upon impact with a short iron, thereby suppressing generation of a wrinkle. In this respect, the pencil hardness is more preferably equal to or greater than 3B, and still more preferably equal to or greater than B. Too high pencil hardness leads to difficulty in following of the reinforcing layer 8 to the cover 10 upon impact with a short iron. When the following is insufficient, the reinforcing layer 8 is cleaved to generate a wrinkle. In light of suppression of the wrinkle, the pencil hardness is preferably equal to or less than 3H, and more preferably equal to or less than 2H. The pencil hardness is measured in accordance with a standard of "JIS K5400".

The cover 10 comprises a thermoplastic resin composition. The base polymer of this resin composition is a thermoplastic polyurethane elastomer. Thermoplastic polyurethane elastomers are soft. Great spin rate is achieved when the golf ball 2 having a cover 10 which comprises a thermoplastic polyurethane elastomer is hit with a short iron. The cover 10 comprising a thermoplastic polyurethane elastomer is responsible for a control performance upon a shot with a short iron. The thermoplastic polyurethane elastomer is also responsible for the scuff resistance of the cover 10.

The thermoplastic polyurethane elastomer includes a polyurethane component as a hard segment, and a polyester component or a polyether component as a soft segment. Illustrative examples of the curing agent for the polyurethane component include alicyclic diisocyanate, aromatic diisocyanate and aliphatic diisocyanate. In particular, alicyclic diisocyanate is preferred. Because the alicyclic diisocyanate has no double bond in the main chain, yellowing of the cover 10 can be suppressed. Additionally, because the alicyclic diisocyanate is excellent in strength, the cover 10 can be prevented from being scuffed. Two or more kinds of diisocyanates may be used in combination.

Illustrative examples of the alicyclic diisocyanate include 4,4'-dicyclohexylmethane diisocyanate ($H_{12}$MDI), 1,3-bis (isocyanatomethyl)cyclohexane ($H_6$XDI), isophorone diisocyanate (IPDI) and trans-1,4-cyclohexane diisocyanate (CHDI). In light of versatility and processability, $H_{12}$MDI is preferred.

Illustrative examples of the aromatic diisocyanate include 4,4'-diphenylmethane diisocyanate (MDI) and toluene diisocyanate (TDI). Illustrative examples of the aliphatic diisocyanate include hexamethylene diisocyanate (HDI).

Specific examples of the thermoplastic polyurethane elastomer include trade name "Elastollan XNY90A", trade name "Elastollan XNY97A", trade name "Elastollan XNY585" and trade name "Elastollan XKP016N", available from BASF Japan Ltd; and trade name "Rezamin P4585LS" and trade name "Rezamin PS62490", available from Dainichiseika Color & Chemicals Mfg. Co., Ltd.

Other resin may be used in combination with the thermoplastic polyurethane elastomer in the cover 10. Examples of the other resin include thermoplastic polyester elastomers, thermoplastic polyamide elastomers, thermoplastic polyolefin elastomers, thermoplastic polystyrene elastomers and ionomer resins.

When other resin is used in combination with a thermoplastic polyurethane elastomer, the thermoplastic polyurethane elastomer is included in the base polymer as a principal component, in light of the control performance. Proportion of the thermoplastic polyurethane elastomer occupying in total base polymer is preferably equal to or greater than 50% by weight, more preferably equal to or greater than 70% by weight, and particularly preferably equal to or greater than 85% by weight.

Into the cover 10 may be blended a coloring agent such as titanium dioxide, a filler such as barium sulfate, a dispersant, an antioxidant, an ultraviolet absorbent, a light stabilizer, a fluorescent agent, a fluorescent brightening agent and the like in an appropriate amount as needed. Also, the cover 10 may be blended with powder of a highly dense metal such as tungsten, molybdenum or the like for the purpose of adjusting the specific gravity.

The cover 10 has a hardness Hc of equal to or less than 54. By employing such a soft cover 10, a favorable control performance may be accomplished upon a shot with a short iron. In light of the control performance, it is preferred that the hardness Hc is equal to or less than 50, and further, equal to or less than 47. In light of the flight performance upon shots with a driver, a long iron and a middle iron, it is preferred that the hardness Hc is equal to or greater than 20, still more equal to or greater than 28, and yet more equal to or greater than 33.

The cover 10 has a nominal thickness Tc of equal to or less than 0.6 mm. As described above, the cover 10 has a low hardness. The cover 10 having such a low hardness is disadvantageous in terms of resilience coefficient of the golf ball 2. Upon shots with a driver, the mid layer 6 as well as the core 4 of the golf ball 2 is deformed greatly. By setting the nominal thickness Tc to be equal to or less than 0.6 mm, the cover 10 does not adversely affect the resilience coefficient to a large extent upon a shot with a driver, even though the cover 10 has a low hardness. An excellent flight performance can be achieved upon a shot with a driver through using the ionomer resin in the mid layer 6. Nominal thickness Tc means a thickness of the cover immediately below the land 14. When a golf ball is assumed as being a globe, polar coordinate is represented by ($\theta$, $\phi$) in which $\theta$ is latitude; and $\phi$ is longitude. Twelve reference points having the polar coordinate of (10, 0), (25, 0), (40, 0), (55, 0), (70, 0), (85, 0), (10, 90), (25, 90), (40, 90), (55, 90), (70, 90) and (85, 90) are selected, and the thickness of the cover 10 is measured immediately below the land 14 positioned at the nearest to this reference point. Mean value of thus resulting date from 12 points is the nominal thickness Tc.

In light of the flight performance, the nominal thickness Tc is more preferably equal to or less than 0.5 mm, and particularly preferably equal to or less than 0.4 mm. In light of ease in forming the cover 10, the nominal thickness Tc is preferably equal to or greater than 0.1 mm, and more preferably equal to or greater than 0.2 mm.

Figure 2:
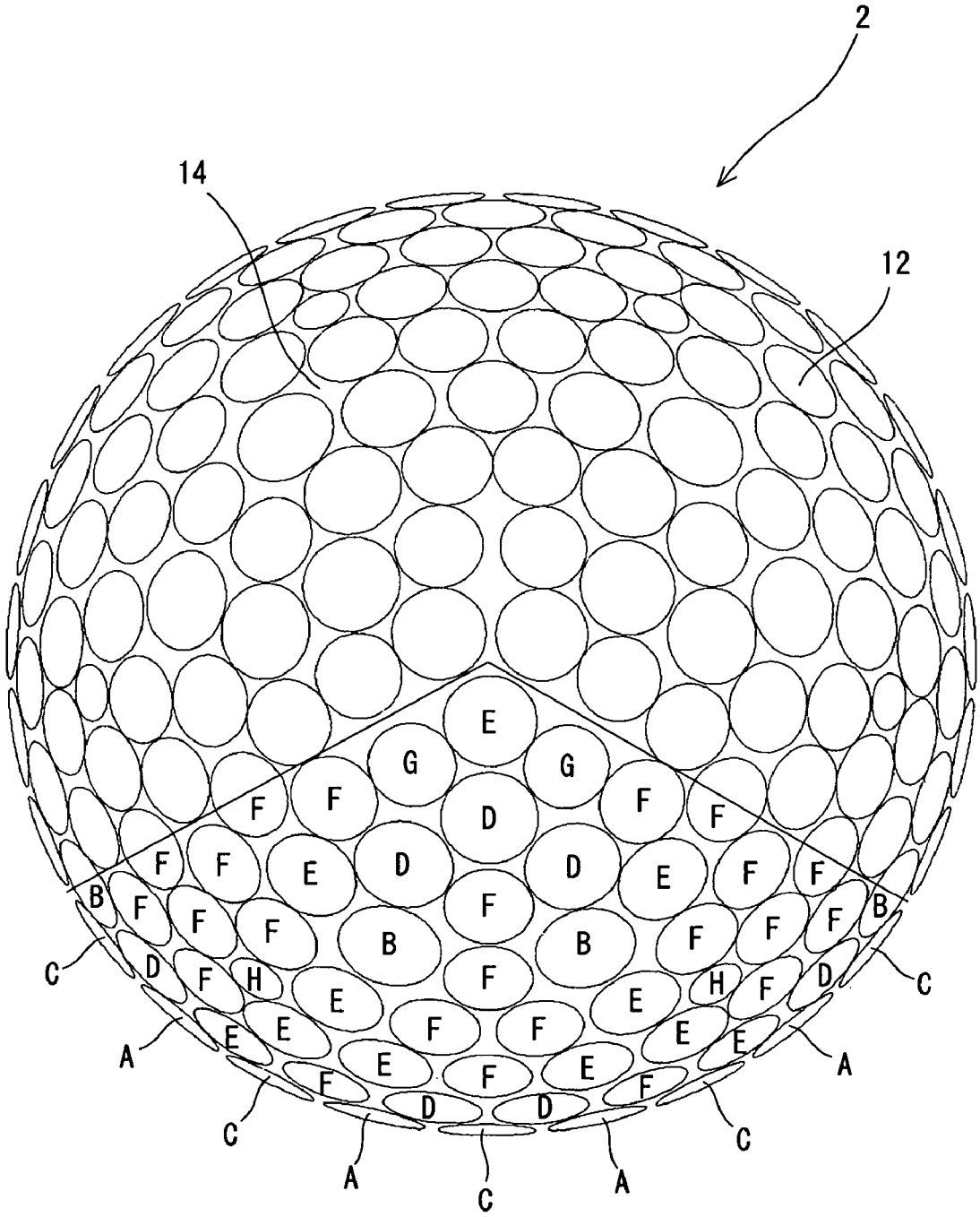
FIG. 2 is an enlarged plan view illustrating the golf ball shown in FIG. 1.
Figure 3:
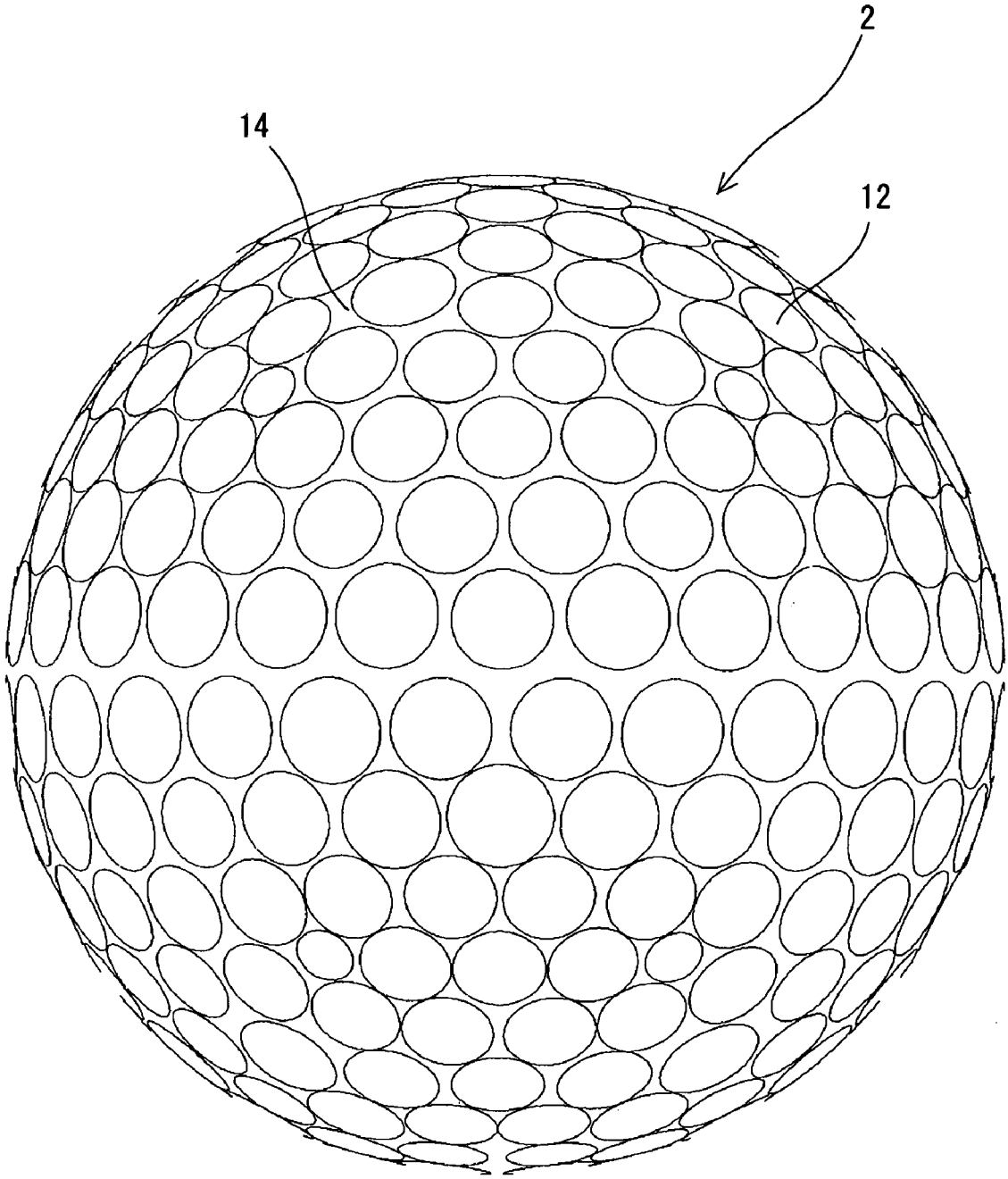
FIG. 3 is a front view illustrating the golf ball shown in FIG. 2.

FIG. 2 is an enlarged plan view illustrating the golf ball 2 shown in FIG. 1, and FIG. 3 is a front view illustrating the golf ball 2 shown in FIG. 2. As is clear from FIG. 2 and FIG. 3, plane shape of all the dimples 12 is circular. In FIG. 2, kinds of the dimples 12 are illustrated by symbols of A to H. This golf ball 2 has dimples A having a diameter of 4.70 mm, dimples B having a diameter of 4.60 mm, dimples C having a diameter of 4.50 mm, dimples D having a diameter of 4.40 mm, dimples E having a diameter of 4.20 mm, dimples F having a diameter of 4.00 mm, dimples G having a diameter of 3.90 mm and dimples H having a diameter of 2.60 mm. The number of the dimples A is 24; the number of the dimples B is 18; the number of the dimples C is 30; the number of the dimples D is 42; the number of the dimples E is 66; the number of the dimples F is 126; the number of the dimples G is 12; and the number of the dimples H is 12. Total number of the dimples 12 of this golf ball 2 is 330.

Figure 4:
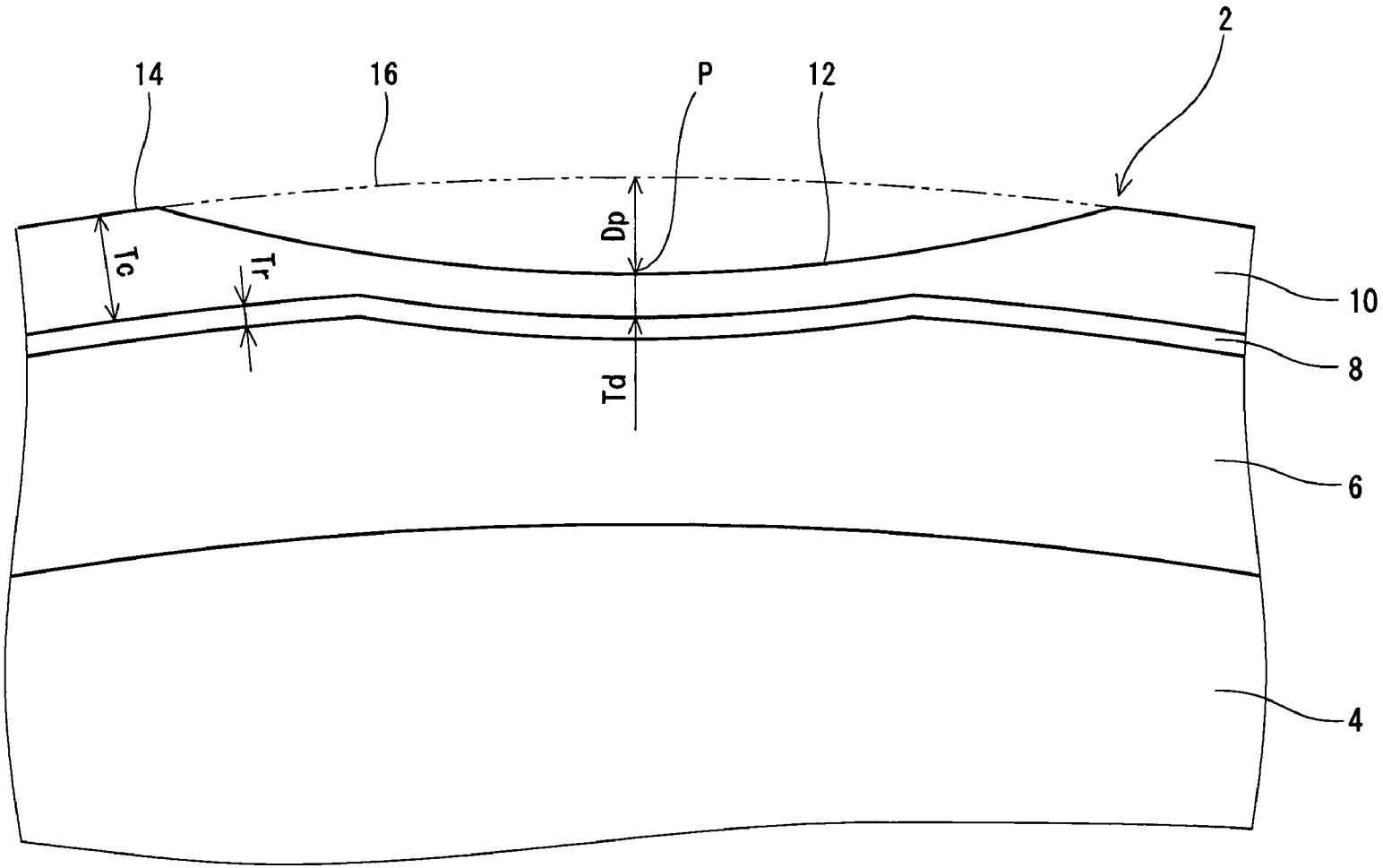
FIG. 4 is an enlarged cross sectional view illustrating a part of the golf ball shown in FIG. 1.

FIG. 4 is an enlarged cross-sectional view illustrating a part of the golf ball 2 shown in FIG. 1. In this Figure, a cross section along a plane passing through a deepest place P of the dimple 12 and the center of the golf ball 2 is shown. A top-to-bottom direction in FIG. 4 is an in-depth direction of the dimple 12. The in-depth direction is a direction from the weighted center of area of the dimple 12 toward the center of the golf ball 2. What is indicated by a chain double-dashed line 16 in FIG. 4 is a phantom sphere. The surface of the phantom sphere 16 corresponds to a surface of the golf ball 2 when it is postulated that there is no dimple 12 existed. The dimple 12 is recessed from the phantom sphere 16. The land 14 agrees with the phantom sphere 16.

What is indicated by a both-sided arrowhead Dp in FIG. 4 is depth of the dimple 12. The depth Dp is a distance between the phantom sphere 16 and the deepest site P. What is indicated by a both-sided arrowhead Td in FIG. 4 is a thickness of the cover 10 immediately below the deepest site P. Because the dimples 12 is recessed from the phantom sphere 16 as described above, the thickness Td is smaller than the nominal thickness Tc. The cover 10 immediately below the deepest site P is thin. Generally, thinner part among the cover 10 is liable to be cut upon impact of a golf ball with a short iron. In the golf ball 2 shown in FIG. 4, the mid layer 6 and the reinforcing layer 8 are recessed immediately below the deepest site P. In other words, the thickness Td is greater than (Tc−Dp). The nominal thickness Tc of this golf ball 2 is extremely small as described above, however, cutting of the cover 10 immediately below the deepest site P is suppressed because the thickness Td is set to be greater than (Tc−Dp). This golf ball 2 is excellent in durability irrespective of the nominal thickness Tc of the cover 10 being extremely small, and of the cover 10 being soft.

In light of the durability, proportion P1 of number of the dimples 12 on the cover 10 having a thickness Td immediately below the deepest site P of the dimple 12 of greater than (Tc−Dp), occupying in total number of the dimples 12 is preferably equal to or greater than 30%, more preferably equal to or greater than 60%, and particularly preferably equal to or greater than 80%. This proportion P1 is ideally 100%.

In light of the durability, it is preferred that all of the dimples 12 having a depth Dp of equal to or greater than 0.20 mm are on the cover 10 having a thickness Td immediately below the deepest site P of the dimple 12 of greater than (Tc−Dp).

In light of the durability, the thickness Td is equal to or greater than (Tc−Dp+0.03). In light of the durability, proportion P2 of number of the dimples 12 on the cover 10 having a thickness Td immediately below the deepest site P of the dimple 12 of equal to or greater than (Tc−Dp+0.03), occupying in total number of the dimples 12 is preferably equal to or greater than 30%, more preferably equal to or greater than 60%, and particularly preferably equal to or greater than 80%. This proportion P2 is ideally 100%.

In light of the durability, it is preferred that all of the dimples 12 having a depth Dp of equal to or greater than 0.20 mm are on the cover 10 having a thickness Td immediately below the deepest site P of the dimple 12 of equal to or greater than (Tc−Dp+0.03).

For manufacturing this golf ball 2, compression molding is suitable employed. Upon manufacture of the golf ball 2 by compression molding, half shells are first obtained from a resin composition comprising a thermoplastic polyurethane elastomer as a base polymer. Next, a spherical body comprising the core 4, the mid layer 6 and the reinforcing layer 8 is covered by two pieces of the half shell. Next, this spherical body and half shells are placed into a mold having a spherical cavity face, and then compressed and heated. The cavity face has numerous pimples. The compression and heating allows the resin composition to flow inside of the mold, whereby forming the cover 10. On the surface of the cover 10 are formed dimples 12 having a shape inverted from the shape of the pimples. The pimple also presses the reinforcing layer 8 and the mid layer 6. According to the pressing, the reinforcing layer 8 and the mid layer 6 are recessed. This recession results in the cover 10 that is resistant to cutting. The recession of the reinforcing layer 8 and the mid layer 6 promotes flow of the resin composition during compression and heating.

EXAMPLES

Hereinafter, advantages of the present invention will be apparent by way of Examples, however, the present invention should not be construed as being limited by description of the Examples.

Example 1

A rubber composition was obtained by kneading 100 parts by weight of polybutadiene (trade name "BR-730", available from JSR Corporation), 37 parts by weight of zinc diacrylate, an appropriate amount of zinc oxide, 0.7 part by weight of bis(pentabromophenyl)disulfide and 0.9 part by weight of dicumyl peroxide. This rubber composition was placed into a mold having upper and lower mold half each having a hemispherical cavity, and heated under a temperature of 170° C. for 15 minutes to obtain a core having a diameter of 38.5 mm. This core had a weight of 34.9 g.

A type z resin composition shown in Table 1 below was obtained with a biaxial extruder. Around the core was covered with this resin composition by injection molding to give a mid layer. This mid layer had a thickness Tm of 1.5 mm and a hardness Hm of 63.

A coating composition containing a two-component cured epoxy resin as a base polymer (trade name "POLIN 750LE", available from Shinto Paint Co., Ltd.) was prepared. The base material liquid of this coating composition consists of 30 parts by weight of a bisphenol A type solid epoxy resin and 70 parts by weight of a solvent. The curing agent liquid of this coating composition consists of 40 parts by weight of denatured polyamide amine, 55 parts by weight of a solvent and 5 parts by weight of titanium oxide. Weight ratio of the base material liquid and the curing agent liquid is 1/1. This coating composition was applied on the surface of the mid layer with a spray gun, and kept in an atmosphere of 40° C. for 24 hours to give a reinforcing layer. This reinforcing layer had a thickness Tr of 0.003 mm.

A type c resin composition shown in Table 2 below was obtained with a biaxial extruder. Half shells were obtained from this resin composition with compression molding. A spherical body comprising the core, the mid layer and the reinforcing layer was covered by two pieces of the half shell, and then placed into a mold having upper and lower mold half each having a hemispherical cavity to obtain a cover with compression molding. The cover had a nominal thickness Tc of 0.6 mm. A paint layer was formed around this cover to give a golf ball of Example 1. This golf ball had a diameter of 42.7 mm.

Examples 2 to 4 and Comparative Examples 1 to 5

In a similar method of manufacture to Example 1, golf balls with specifications as presented in Tables 1 to 7 below were obtained. A coating composition comprising a two-component cured urethane resin as a base polymer was used in the reinforcing layer in Example 2 and Comparative Examples 1, 3 and 5. In production of this coating composition, 116 parts by weight of PTMG and 16 parts by weight of 1,2,6-hexanetriol were first dissolved in 120 parts by weight of a solvent (mixed liquid of toluene and methyl ethyl ketone). To this solution was added dibutyltin dilaurate to give the concentration of 0.1% by weight. To this solution was added 48 parts by weight of isophorone diisocyanate dropwise while keeping at 80° C. to obtain a base material liquid containing urethane polyol. Solid content of this urethane polyol was 60% by weight, with a hydroxyl value being 87 mg KOH/g, and with a weight average molecular weight being 7850. This base material liquid and a curing agent liquid containing isophorone diisocyanate (manufactured by Sumitomo Bayer Urethane Co., Ltd.) were mixed to give a molar ratio of NCO/OH being 1.2. To this liquid were added a light stabilizer (trade name "Sanol LS770", available from Sankyo Co., Ltd.), an ultraviolet absorbent (trade name "TINUVIN® 900", available from Ciba-Geigy Co.) and a fluorescent brightening agent (trade name "UVITEX® OB", available from Ciba-Geigy Co.") to prepare a coating composition. Amounts as added per 100 parts by weight of the urethane resin component are 2 parts by weight for the light stabilizer, 2 parts by weight for the ultraviolet absorbent and 0.2 part by weight for the fluorescent brightening agent.

Comparative Example 6

In a similar method of manufacture to Example 1 except that the cover was formed with injection molding, a golf ball having specifications shown in Tables 1 to 7 below was obtained.

Comparative Example 7

In a similar method of manufacture to Example 1 except that the cover was formed with injection molding, and that the reinforcing layer was obtained in a similar method of manufacture to Example 2, a golf ball having specifications shown in Tables 1 to 7 below was obtained.

[Shot with Driver]

A driver with a metal head was attached to a swing machine available from Golf Laboratory Co. Then the machine condition was set to give the head speed of 50 m/sec, and the golf balls were hit therewith. Accordingly, ball speed immediately after the hit and travel distance (i.e., the distance from the launching point to the point where the ball stopped) were measured. Mean values of 10 times measurement are shown in Table 6 and Table 7 below.

[Shot with Middle Iron]

To the swing machine described above was attached a number five iron. Then the machine condition was set to give the head speed of 41 m/sec, and the golf balls were hit therewith. Accordingly, spin rate immediately after the hit and travel distance were measured. Mean values of 10 times measurement are shown in Table 6 and Table 7 below.

[Shot with Short Iron]

To the swing machine described above was attached an approach wedge. Then the machine condition was set to give the head speed of 21 m/sec, and the golf balls were hit therewith. Accordingly, spin rate immediately after the hit was measured. Mean values of 10 times measurement are shown in Table 6 and Table 7 below.

[Evaluation of Extent of Wrinkle Generation]

To the swing machine described above was attached a pitching wedge. Then the machine condition was set to give the head speed of 37 m/sec, and the golf balls were hit therewith. Accordingly, the surface of the golf ball was visually observed, and the case in which there was no wrinkle was assigned as "Good", while the case in which there was any wrinkle was assigned as "No Good". The results are presented in Table 6 and Table 7 below.

[Evaluation of Durability on Breaking Test]

The golf balls were rendered to hit repeatedly on a metal plate at a velocity of 45 m/s, and the number of times of the hitting until the golf ball was broken was counted. Mean values of measurement of six golf balls are shown in Table 6 and Table 7 below.

TABLE 1

| Specification of mid layer (parts by weight) | Type | | |
|---|---|---|---|
| | x | y | z |
| Surlyn 6320 | — | 40 | — |
| Rabalon SR04 * | 25 | — | — |
| Himilan 1605 | 37.5 | 30 | 50 |
| Surlyn 9945 | 37.5 | 30 | 50 |
| Titanium dioxide | 4 | 4 | 4 |

TABLE 1-continued

| Specification of mid layer (parts by weight) | Type | | |
|---|---|---|---|
| | x | y | z |
| Ultramarine blue | 0.1 | 0.1 | 0.1 |
| Hardness (Shore D) | 53 | 57 | 63 |

* thermoplastic styrene elastomer, available from Mitsubishi Chemical Corporation

TABLE 2

| Specification of cover (parts by weight) | Type | | | |
|---|---|---|---|---|
| | a | b | c | d |
| Rezamin P4585LS | 100 | — | — | — |
| Elastollan XNY97A | — | 100 | 50 | — |
| Elastollan XKP016N | — | — | 50 | 100 |
| Titanium dioxide | 4 | 4 | 4 | 4 |
| Ultramarine blue | 0.1 | 0.1 | 0.1 | 0.1 |
| Hardness (Shore D) | 33 | 47 | 54 | 58 |

TABLE 3

Detailed specification of dimples

Figure 5:
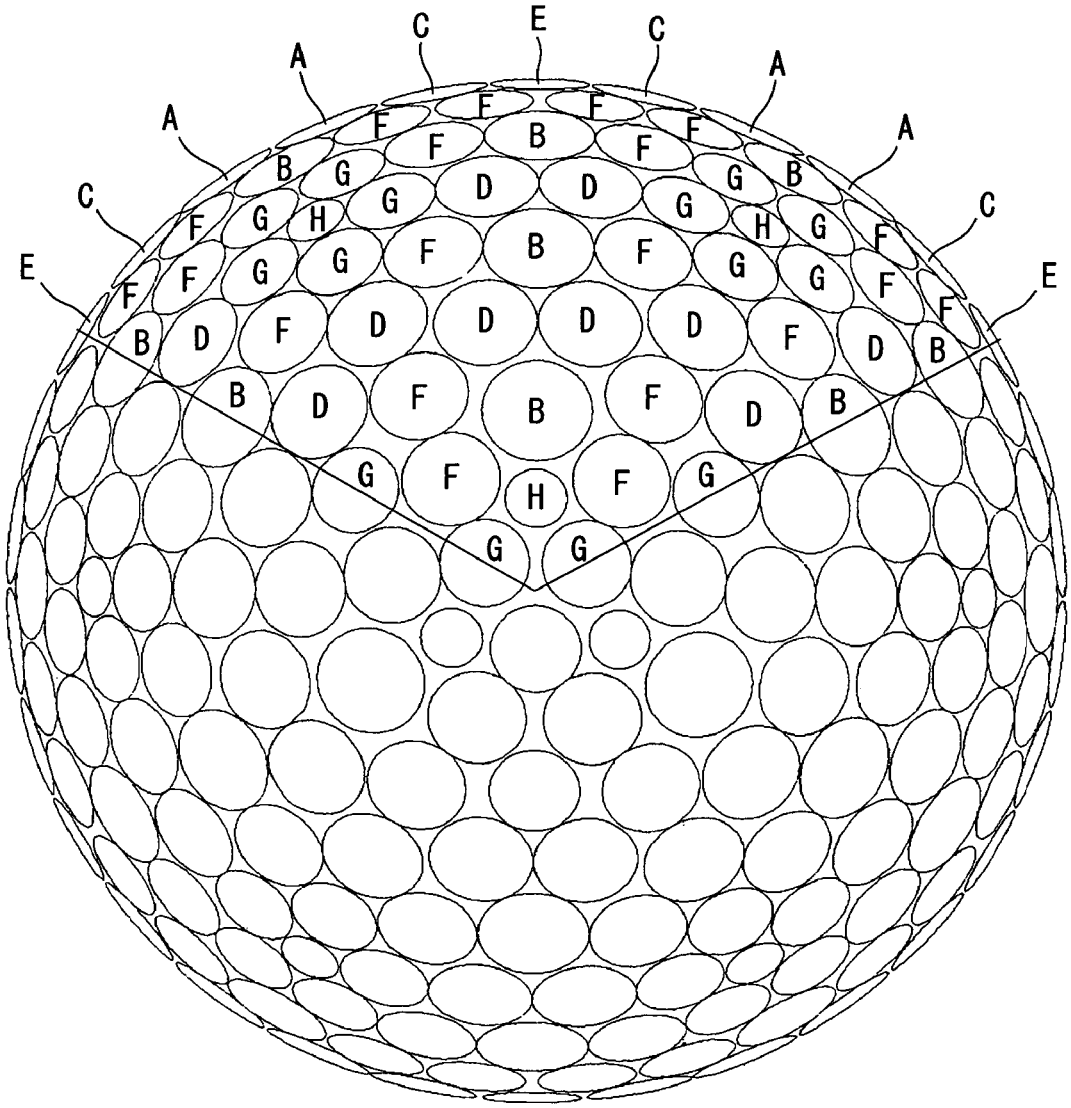
FIG. 5 is an enlarged plan view illustrating a golf ball according to Example 4 of the present invention.
Figure 6:
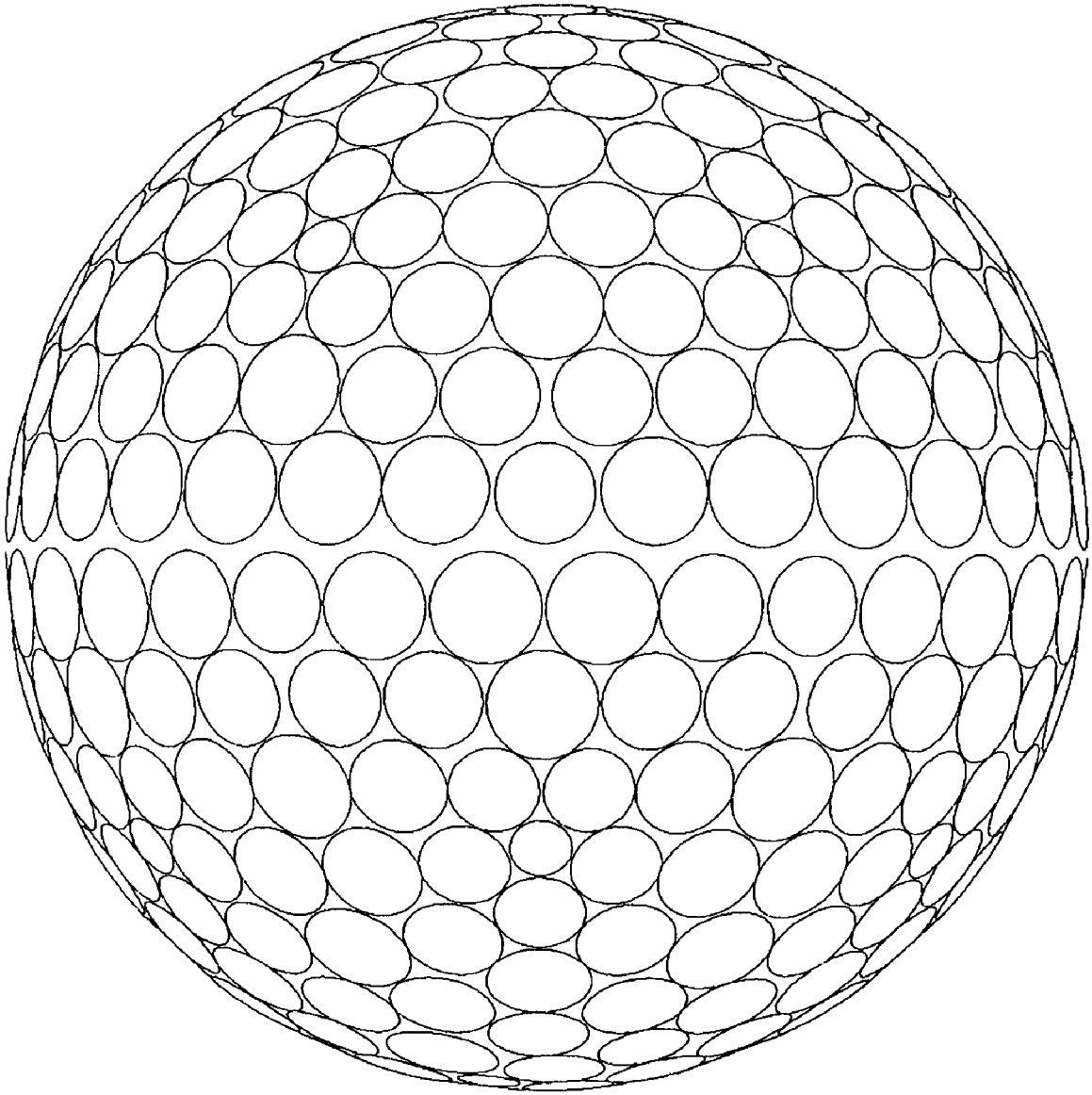
FIG. 6 is a front view illustrating the golf ball shown in FIG. 5.

| Type | Kind | Number | Diameter (mm) | Depth Dp (mm) | Curvature radius (mm) | Volume ($mm^3$) | Total number | Total volume ($mm^3$) | Occupation ratio (%) | Plan view | Front view |
|---|---|---|---|---|---|---|---|---|---|---|---|
| I | A | 24 | 4.70 | 0.308 | 15.60 | 1.547 | 330 | 330.0 | 79 | FIG. 2 | FIG. 3 |
| | B | 18 | 4.60 | 0.282 | 16.82 | 1.315 | | | | | |
| | C | 30 | 4.50 | 0.297 | 14.31 | 1.418 | | | | | |
| | D | 42 | 4.40 | 0.272 | 15.40 | 1.203 | | | | | |
| | E | 66 | 4.20 | 0.239 | 16.40 | 0.936 | | | | | |
| | F | 126 | 4.00 | 0.222 | 15.69 | 0.805 | | | | | |
| | G | 12 | 3.90 | 0.214 | 15.27 | 0.748 | | | | | |
| | H | 12 | 2.60 | 0.160 | 7.10 | 0.319 | | | | | |
| II | A | 24 | 4.60 | 0.280 | 17.03 | 1.298 | 372 | 315.0 | 83 | FIG. 5 | FIG. 6 |
| | B | 42 | 4.50 | 0.252 | 19.10 | 1.059 | | | | | |
| | C | 24 | 4.40 | 0.262 | 16.43 | 1.127 | | | | | |
| | D | 60 | 4.20 | 0.224 | 18.44 | 0.832 | | | | | |
| | E | 12 | 4.10 | 0.240 | 14.97 | 0.932 | | | | | |
| | F | 120 | 4.00 | 0.225 | 15.33 | 0.824 | | | | | |
| | G | 72 | 3.65 | 0.203 | 13.39 | 0.655 | | | | | |
| | H | 18 | 2.50 | 0.154 | 6.74 | 0.288 | | | | | |

TABLE 4

Details of cover and dimples

| | | Example 1 | Example 2 | Example 3 | Example 4 | Comp. Example 1 | Comp. Example 2 |
|---|---|---|---|---|---|---|---|
| Nominal thickness of cover Tc (mm) | | 0.6 | 0.5 | 0.1 | 0.3 | 0.5 | 0.8 |
| Type of dimple pattern | | I | I | I | II | I | I |
| Depth Dp (mm) | Dimple A | 0.308 | 0.308 | 0.308 | 0.280 | 0.308 | 0.308 |
| | Dimple B | 0.282 | 0.282 | 0.282 | 0.252 | 0.282 | 0.282 |
| | Dimple C | 0.297 | 0.297 | 0.297 | 0.262 | 0.297 | 0.297 |
| | Dimple D | 0.272 | 0.272 | 0.272 | 0.224 | 0.272 | 0.272 |
| | Dimple E | 0.239 | 0.239 | 0.239 | 0.240 | 0.239 | 0.239 |
| | Dimple F | 0.222 | 0.222 | 0.222 | 0.225 | 0.222 | 0.222 |

TABLE 4-continued

| | | Details of cover and dimples | | | | | |
|---|---|---|---|---|---|---|---|
| | | Example 1 | Example 2 | Example 3 | Example 4 | Comp. Example 1 | Comp. Example 2 |
| | Dimple G | 0.214 | 0.214 | 0.214 | 0.203 | 0.214 | 0.214 |
| | Dimple H | 0.160 | 0.160 | 0.160 | 0.154 | 0.160 | 0.160 |
| Thickness Td (mm) | Dimple A | 0.428 | 0.355 | 0.052 | 0.242 | 0.355 | 0.535 |
| | Dimple B | 0.417 | 0.334 | 0.058 | 0.238 | 0.334 | 0.553 |
| | Dimple C | 0.405 | 0.324 | 0.056 | 0.231 | 0.324 | 0.541 |
| | Dimple D | 0.413 | 0.327 | 0.060 | 0.228 | 0.327 | 0.557 |
| | Dimple E | 0.404 | 0.315 | 0.069 | 0.215 | 0.315 | 0.562 |
| | Dimple F | 0.414 | 0.322 | 0.071 | 0.220 | 0.322 | 0.578 |
| | Dimple G | 0.417 | 0.323 | 0.073 | 0.220 | 0.323 | 0.586 |
| | Dimple H | 0.440 | 0.340 | 0.075 | 0.190 | 0.340 | 0.640 |
| Td > Tc − Dp | Dimple A | Yes | Yes | Yes | Yes | Yes | Yes |
| | Dimple B | Yes | Yes | Yes | Yes | Yes | Yes |
| | Dimple C | Yes | Yes | Yes | Yes | Yes | Yes |
| | Dimple D | Yes | Yes | Yes | Yes | Yes | Yes |
| | Dimple E | Yes | Yes | Yes | Yes | Yes | Yes |
| | Dimple F | Yes | Yes | Yes | Yes | Yes | No |
| | Dimple G | Yes | Yes | Yes | Yes | Yes | No |
| | Dimple H | No | No | Yes | Yes | No | No |
| Td ≧ Tc − Dp + 0.03 | Dimple A | Yes | Yes | Yes | Yes | Yes | Yes |
| | Dimple B | Yes | Yes | Yes | Yes | Yes | Yes |
| | Dimple C | Yes | Yes | Yes | Yes | Yes | Yes |
| | Dimple D | Yes | Yes | Yes | Yes | Yes | No |
| | Dimple E | Yes | Yes | Yes | Yes | Yes | No |
| | Dimple F | Yes | Yes | Yes | Yes | Yes | No |
| | Dimple G | Yes | Yes | Yes | Yes | Yes | No |
| | Dimple H | No | No | Yes | Yes | No | No |

TABLE 5

| | | Details of cover and dimples | | | | |
|---|---|---|---|---|---|---|
| | | Comp. Example 3 | Comp. Example 4 | Comp. Example 5 | Comp. Example 6 | Comp. Example 7 |
| Nominal thickness of cover Tc (mm) | | 0.5 | 0.5 | 0.1 | 0.6 | 0.5 |
| Type of dimple pattern | | I | I | I | I | I |
| Depth Dp (mm) | Dimple A | 0.308 | 0.308 | 0.308 | 0.308 | 0.308 |
| | Dimple B | 0.282 | 0.282 | 0.282 | 0.282 | 0.282 |
| | Dimple C | 0.297 | 0.297 | 0.297 | 0.297 | 0.297 |
| | Dimple D | 0.272 | 0.272 | 0.272 | 0.272 | 0.272 |
| | Dimple E | 0.239 | 0.239 | 0.239 | 0.239 | 0.239 |
| | Dimple F | 0.222 | 0.222 | 0.222 | 0.222 | 0.222 |
| | Dimple G | 0.214 | 0.214 | 0.214 | 0.214 | 0.214 |
| | Dimple H | 0.160 | 0.160 | 0.160 | 0.160 | 0.160 |
| Thickness Td (mm) | Dimple A | 0.340 | 0.355 | 0.052 | 0.292 | 0.192 |
| | Dimple B | 0.326 | 0.334 | 0.058 | 0.318 | 0.218 |
| | Dimple C | 0.314 | 0.324 | 0.056 | 0.303 | 0.203 |
| | Dimple D | 0.320 | 0.327 | 0.060 | 0.328 | 0.228 |
| | Dimple E | 0.310 | 0.315 | 0.069 | 0.361 | 0.261 |
| | Dimple F | 0.318 | 0.322 | 0.071 | 0.378 | 0.278 |
| | Dimple G | 0.318 | 0.323 | 0.073 | 0.386 | 0.286 |
| | Dimple H | 0.340 | 0.340 | 0.075 | 0.440 | 0.340 |
| Td > Tc − Dp | Dimple A | Yes | Yes | Yes | No | No |
| | Dimple B | Yes | Yes | Yes | No | No |
| | Dimple C | Yes | Yes | Yes | No | No |
| | Dimple D | Yes | Yes | Yes | No | No |
| | Dimple E | Yes | Yes | Yes | No | No |
| | Dimple F | Yes | Yes | Yes | No | No |
| | Dimple G | Yes | Yes | Yes | No | No |
| | Dimple H | No | No | Yes | No | No |
| Td ≧ Tc − Dp + 0.03 | Dimple A | Yes | Yes | Yes | No | No |
| | Dimple B | Yes | Yes | Yes | No | No |
| | Dimple C | Yes | Yes | Yes | No | No |
| | Dimple D | Yes | Yes | Yes | No | No |
| | Dimple E | Yes | Yes | Yes | No | No |
| | Dimple F | Yes | Yes | Yes | No | No |
| | Dimple G | Yes | Yes | Yes | No | No |
| | Dimple H | No | No | Yes | No | No |

TABLE 6

| | | Results of evaluation | | | | | |
|---|---|---|---|---|---|---|---|
| | | Example 1 | Example 2 | Example 3 | Example 4 | Comp. Example 1 | Comp. Example 2 |
| Core | Diameter (mm) | 38.5 | 39.7 | 38.3 | 40.9 | 39.7 | 38.1 |
| Mid layer | Type | z | z | z | y | x | z |
| | Thickness Tm (mm) | 1.5 | 1.0 | 2.0 | 0.6 | 1.0 | 1.5 |
| | Hardness Hm | 63 | 63 | 63 | 57 | 53 | 63 |
| Reinforcing layer | Base polymer | epoxy | urethane | epoxy | epoxy | urethane | epoxy |
| | Thickness Tr (mm) | 0.003 | 0.01 | 0.10 | 0.01 | 0.01 | 0.01 |
| | Tensile strength ($kgf/cm^2$) | 410 | 221 | 410 | 410 | 221 | 410 |
| | Pencil hardness | 2H | B | 2H | 2H | B | 2H |
| Cover | Type | c | b | a | b | b | b |
| | Thickness Tc (mm) | 0.6 | 0.5 | 0.1 | 0.3 | 0.5 | 0.8 |
| | Hardness Hc | 54 | 47 | 33 | 47 | 47 | 47 |
| | Molding method | CM | CM | CM | CM | CM | CM |
| Ratio (Tr/Tc) | | 0.005 | 0.020 | 1.000 | 0.033 | 0.020 | 0.013 |
| Dimple | Type | I | I | I | II | I | I |
| | Proportion P1 (%) | 96 | 96 | 100 | 100 | 96 | 55 |
| | Proportion P2 (%) | 96 | 96 | 100 | 100 | 96 | 22 |
| Shot with driver | Ball speed (m/s) | 73.2 | 72.9 | 73.5 | 73.0 | 72.4 | 72.5 |
| | Travel distance (m) | 287.1 | 285.3 | 288.0 | 287.1 | 277.5 | 278.0 |
| Shot with #5 iron | Spin rate (rpm) | 4400 | 4500 | 4450 | 4400 | 4900 | 4750 |
| | Travel distance (m) | 174.7 | 173.7 | 176.0 | 174.2 | 167.8 | 169.2 |
| Shot with approach wedge | Spin rate (rpm) | 6600 | 6750 | 6850 | 6900 | 6800 | 6850 |
| Extent of wrinkle | | Good | Good | Good | Good | Good | Good |
| Breaking test | | Over 200 | Over 200 | Over 200 | Over 200 | Over 200 | Over 200 |

CM: Compression Molding,
IM: Injection Molding

TABLE 7

| | | Results of evaluation | | | | |
|---|---|---|---|---|---|---|
| | | Comp. Example 3 | Comp. Example 4 | Comp. Example 5 | Comp. Example 6 | Comp. Example 7 |
| Core | Diameter (mm) | 39.7 | 39.7 | 37.7 | 38.5 | 39.7 |
| Mid layer | Type | z | z | z | z | z |
| | Thickness Tm (mm) | 1.0 | 1.0 | 2.0 | 1.5 | 1.0 |
| | Hardness Hm | 63 | 63 | 63 | 63 | 63 |
| Reinforcing layer | Base polymer | urethane | — | urethane | epoxy | urethane |
| | Thickness Tr (mm) | 0.01 | — | 0.40 | 0.003 | 0.01 |
| | Tensile strength ($kgf/cm^2$) | 221 | — | 221 | 410 | 221 |
| | Pencil hardness | B | — | B | 2H | B |
| Cover | Type | d | b | a | c | b |
| | Thickness Tc (mm) | 0.5 | 0.5 | 0.1 | 0.6 | 0.5 |
| | Hardness Hc | 58 | 47 | 33 | 54 | 47 |
| | Molding method | CM | CM | CM | IM | IM |
| Ratio (Tr/Tc) | | 0.020 | — | 4.000 | 0.005 | 0.020 |
| Dimple | Type | I | I | I | I | I |
| | Proportion P1 (%) | 96 | 96 | 100 | 0 | 0 |
| | Proportion P2 (%) | 96 | 96 | 100 | 0 | 0 |
| Shot with driver | Ball speed (m/s) | 73.0 | 72.8 | 72.5 | 73.1 | 72.8 |
| | Travel distance (m) | 285.8 | 283.5 | 278.0 | 286.2 | 285.3 |
| Shot with #5 iron | Spin rate (rpm) | 4300 | 4500 | 4900 | 4450 | 4450 |
| | Travel distance (m) | 175.6 | 172.4 | 167.8 | 174.7 | 173.3 |
| Shot with approach wedge | Spin rate (rpm) | 5900 | 6600 | 6950 | 6300 | 6500 |
| Extent of wrinkle | | Good | No Good | Good | No Good | No Good |
| Breaking test | | Over 200 | 2 | 62 | 36 | 29 |

CM: Compression Molding,
IM: Injection Molding

As is clear from Table 6 and Table 7, the golf ball of each of Examples is excellent in the flight performance upon shots with a driver and a middle iron, in the spin performance upon shots with a short iron, and in the durability. Accordingly, advantages of the present invention are clearly indicated by these results of evaluation.

The description herein above is merely for illustrative examples, and various modifications can be made without departing from the principles of the present invention.

What is claimed is:

1. A golf ball which comprises a spherical core, a mid layer positioned outside of the core, a reinforcing layer positioned outside of the mid layer and a cover positioned outside of the reinforcing layer, wherein the principal component of the base polymer of said mid layer is an ionomer resin, said mid layer having a hardness Hm as measured with a Shore D type hardness scale of equal to or greater than 55, the principal component of the base polymer of said cover is a thermoplastic polyurethane elastomer, said cover having a nominal thickness Tc of equal to or less than 0.6 mm, said cover having a hardness Hc as measured with a Shore D type hardness scale of equal to or less than 54, the ratio (Tr/Tc) of the thickness Tr of said reinforcing layer to the nominal thickness Tc of said cover is 0.005 or greater and 3.0 or less, said goff ball comprising dimples having a depth Dp on the surface thereof, and the thickness Td of the cover immediately below the deepest site of one or more of the dimples is greater than (Tc−Dp).

2. The golf ball according to claim 1 wherein the proportion P1 of the number of the dimples on the cover having a thickness Td immediately below the deepest site of the dimple of greater than (Tc−Dp), to the total number of the dimples is equal to or greater than 30%.

3. The golf ball according to claim 2 wherein the proportion P2 of the number of the dimples on the cover having a thickness Td immediately below the deepest site of the dimple of equal to or greater than (Tc−Dp+0.03), to the total number of the dimples is equal to or greater than 30%.

4. The golf ball according to claim 1 wherein the base polymer of said reinforcing layer is a thermosetting resin.

5. The golf ball according to claim 1 wherein said reinforcing layer has a tensile strength of 150 $kgf/cm^2$ or greater and 500 $kgf/cm^2$ or less.

6. The golf ball according to claim 1 wherein said reinforcing layer has a pencil hardness of 4B or greater and 3H or less.

7. The golf ball according to claim 1 wherein both the reinforcing layer and the mid layer are recessed below the dimples.

* * * * *